United States Patent [19]

Ellman et al.

[11] 4,303,240

[45] Dec. 1, 1981

[54] MOVING BLOCK GAME

[76] Inventors: Steven Ellman; Fredric Ellman, both of 1672 E. 7th St., Brooklyn, N.Y. 11230; George Lerner, 12 Prospect Ct., Freeport, N.Y. 11520; Julius Ellman, 1672 E. 7th St., Brooklyn, N.Y. 11230

[21] Appl. No.: 120,998

[22] Filed: Feb. 13, 1980

[51] Int. Cl.[3] ..... A63F 9/00

[52] U.S. Cl. ..... 273/1 GF; 46/122

[58] Field of Search ..... 273/1 R, 1 E, 1 M, 1 GC, 273/1 CD, 1 GF; 272/46; 46/25

[56] References Cited

U.S. PATENT DOCUMENTS

| | | | |
|---|---|---|---|
| 706,094 | 8/1902 | O'Brien | 272/46 |
| 920,567 | 5/1909 | Hayes | 272/46 |
| 3,754,759 | 8/1973 | Breslow et al. | 273/1 R |
| 3,785,647 | 1/1974 | Bender | 273/1 R X |
| 3,979,119 | 9/1976 | Cecchetti | 46/25 X |

*Primary Examiner*—Paul E. Shapiro

*Attorney, Agent, or Firm*—Lackenbach, Siegel, Marzullo, Presta & Aronson

[57] ABSTRACT

The game comprises a base, a movable table mounted on the base, a drive system for powering the movable table, a designated playing area on said table and a plurality of playing blocks. The game is played by one or more players who sequentially place playing blocks of different sizes and shapes on the designated playing area or on another previously positioned playing block while the table is moved, preferably in a circular manner, with the player who first disposes of all blocks being the winner.

22 Claims, 4 Drawing Figures

MOVING BLOCK GAME

BACKGROUND OF THE INVENTION

The invention relates to toys and, more particularly, to a game of the type comprising a form of building blocks.

Heretofore, in the prior art, toys or games involving building blocks were all limited to static conditions in that blocks or other types of building elements were stacked in place by one or more players. The object of such toys or games is to develop and improve one's dexterity or manual skills and in not being responsible for the collapse of the blocks.

Although such toys or games, such as "BLOCK HEADS", a trademark of Parker Brothers of Salem, Mass., have been widely enjoyed in the past, they are not challenging or dynamic enough in today's market as they lack excitement and stimulation and are no longer considered to thrill or fascinate a player.

It should also be recognized that although anyone could play, the prior art toys or games were generally limited to toddlers and children of a young age because of the minimum skills required and the lack of any real challenge to stacking a plurality of blocks, even in those toys or games employing blocks of different sizes and shapes.

SUMMARY OF THE INVENTION

It is therefore the primary object of the invention to provide a toy game of the type employing building blocks wherein the blocks are stacked on a moving substrate which is capable of moving from one player's area or zone to another's zone.

It is another object of the invention to provide a toy game embodying a rotary turntable having a designated area in the form of a platform mounted on the turntable for supporting a plurality of blocks piled atop each other or on the designated platform area.

It is a further object of the invention to provide a toy game employing a turntable which may also be of the adjustable type capable of different rotational speeds.

It is yet a further object of the invention to provide a toy game with a horizontally disposed turntable and a small platform fixed at the periphery thereof for supporting blocks stacked or piled on the platform.

It is also an object of the present invention to provide a toy game of extreme challenge and one which requires considerable skill and may be played by virtually everyone of any age group except children still classified in the infancy stage of development.

Accordingly, in order to achieve these and other objects of the invention which will become apparent hereinafter, the invention comprises a toy game having a rotatable table mounted on a base, with suitable drive means for rotating the table a designated playing area on said table and a plurality of playing blocks. The playing blocks are sequentially placed on the designated playing area or on another playing block by one or more players as the table is rotated, and each player having a set of blocks of different shapes.

Thus, the objects of the invention are more particularly achieved by a game comprising a base adapted to be placed on a substrate, such as a floor or table, a movable table mounted on said base, drive means for moving said table in one plane, and means for gradually raising and then lowering said table, a single designated playing area attached to said movable table and a plurality of playing blocks, wherein said playing blocks are sequentially placed on said designated playing area or on another playing block by one or more players while said movable table is continuously moved around and intermittently moved up and down.

The present invention will be better understood and the objects and features, other than those specifically enumerated above, will become apparent when consideration is given to the following details and description, which when taken in conjunction with the annexed drawings, describes, discloses, illustrates and shows a preferred embodiment or modification of the present invention and what is presently considered and believed to be the best mode of practice in the principles thereof. Other embodiments or modifications may be suggested to those having the benefit of the teachings herein and such other embodiments or modifications are intended to be reserved especially as they fall within the scope of the invention as set forth in the claims following this description or specification.

DESCRIPTION OF THE PREFERRED EMBODIMENTS

Figure 1:
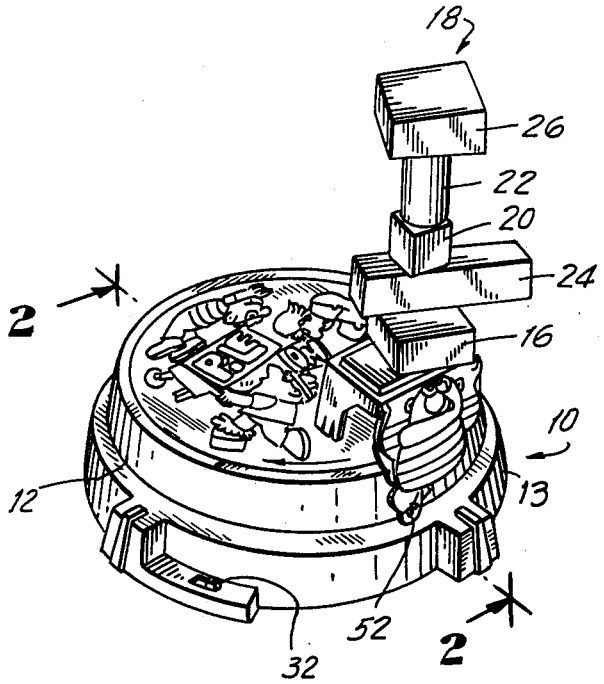
FIG. 1 is a perspective view of the toy game of the present invention.

Referring now to the drawings, there is shown a toy game made in accordance with the invention, and generally designated by the reference numeral 10.

The game 10 has a base 12, and mounted thereon is a rotary turntable 14. The base 12 can be of any reasonable size and shape, but is preferrably of a circular or round shape. In a like manner, the turntable 14 is preferrably of a circular shape and is rotatably mounted on the base 12.

Fixedly mounted on the turntable 14 by suitable means is a platform 16 capable of supporting a plurality of blocks 18. The blocks 18 may comprise cubes, discs, cylindrical rods and tubes, a square or rectangular block of any thickness, pyramids, cones, truncated cones or pyramids, polygonal rods and tubes, and other like solids or tubular forms. Even irregular forms or solids may be used, but spheres are not generally employed as the game would be very difficult. The blocks 18 as illustrated herein comprise a set of five pieces or elements, with four being of different shapes. Thus, there are two cubes 20, one cylindrical rod 22, one elongated square rod 24 and one stubby square block 26 which comprise a complete set. A player receives one set of blocks comprising blocks 20–26, or suitably two or more block sets may be distributed and played by very skilled players. Other shapes of blocks which may be employed, if desired, to enhance the game include a ring or an annular, triangle, rhombus, trapezoid, polygon, such as a pentagon or octagon, prism, torus or any other like figures forming a three-dimensional object or playing piece.

Appropriate apertures in the form of slots 15, are provided in the turntable for engagement with a plurality of projections 17 provided on the platform 16. With this arrangement, the platform 16 is fixedly held in place to the turntable 14.

Mounted within and to the bottom portion of the base 12 by suitable fasteners 27 is a gear housing 28 comprising an electrically-driven motor 30 suitably connected to a power source 31, such as a battery, and switch means 32 of the one-way type for closing and opening the electrical circuit of the "battery" driven motor 30. The motor 30 is provided with a shaft 34 having thereon driver gear or pinion 36. This driver pinion gear 36 in turn rotates a driver gear 38 of the turntable through a suitable gear train comprising a pair of intermediate gears 40 and 42 and an output gear 44 of the output shaft 46 which contains the turntable driver gear 38.

On the underside of the turntable 14 along an inner peripheral portion is a suitable bull gear 48 which is driven by the output driver gear 38. Thus, the turntable 14 is suitably rotated by means of the motor gear train so the motor r.p.m. is reduced to a predetermined r.p.m. at the turntable which is suitably in the order of about 3 r.p.m. Alternately, the turntable 14 may, if desired, be driven by a suitable belt drive in lieu of gearing means.

If desired, a caricature 50 or other figure or illustration can be provided on the outermost side of the platform 16. In order to further animate the caricature 50, the legs 52 may be in the form of a revolving element 54, consisting of 3–4 discrete legs, mounted on or forming part of a shaft 56 having a friction wheel 58 driven by means of such friction wheel 58 rolling or riding along a peripheral rim 60 of the base 12 as the turntable 14 moves relative to the base 12. With this embodiment of the invention, there is provided for the game base a more pleasing effect of a character or caricature balancing shapes or blocks while running around the base of the housing. Of course, other gearing means could be used to drive the shaft 56 in lieu of using a friction drive wheel arrangement, but obviously such a drive system would entail further expense in the fabrication of the toy game. For example, the toes of the caricature could be in the form of gears adapted to ride a crown gear around the perimeter of the base.

The shaft 56 is rotatably mounted on the platform 16 between a pair of apertures 61 provided in opposite side walls of the platform 16. Thus, the legs 52 or other animated objects are caused to rotate, thereby simulating the running movement of the caricature 50 with the blocks 18 being supported on its hands or head or both extremities of the figure.

The turntable 14 is suitably supported centrally along its axis by means of a pivot shaft 62 seated in an apertured opening 64 provided in the base 12. A spring retainer 68 is secured to the pivot shaft 62 of the turntable 14 by means of a suitable fastener 70, and maintains the turntable 14 in place with respect to the base 12. The turntable 14 is thus free to rotate about the axis of the pivot shaft 62. Resilient means, such as the compression spring 66 assists in maintaining the turntable 14 in its properly seated position.

Mounted within the base 12 is a battery box 72 having a suitable set of battery contacts for housing a battery (not shown) electrically connected to the motor 30 and the switch means 32. The battery box 72 is suitably secured to the base 12 using fasteners 73 in a manner as is the gear housing 28. A removable cover 74 encloses the battery box 72 enabling one to replace a battery as is necessary during the life of the game.

If desired, and in order to provide a game requiring more challenging play and skill, the base may be provided with means for gradually raising and then lowering said turntable, and said means comprising a plurality of arcurate, smooth-like surface ramps or cams 49 of say a 30°–60° arc which cause rod-like legs or cam followers 47 provided on the underside of the turntable 14 to ride up the cams 49 so that the turntable 14 and platform 16 rise slightly and then abruptly drops back down every 90° of rotation. Such a construction periodically causes the stacked elements to slightly wobble and this feature also alerts the next player that the stacked pieces or elements are now in his or her quadrant of play.

Figure 2:
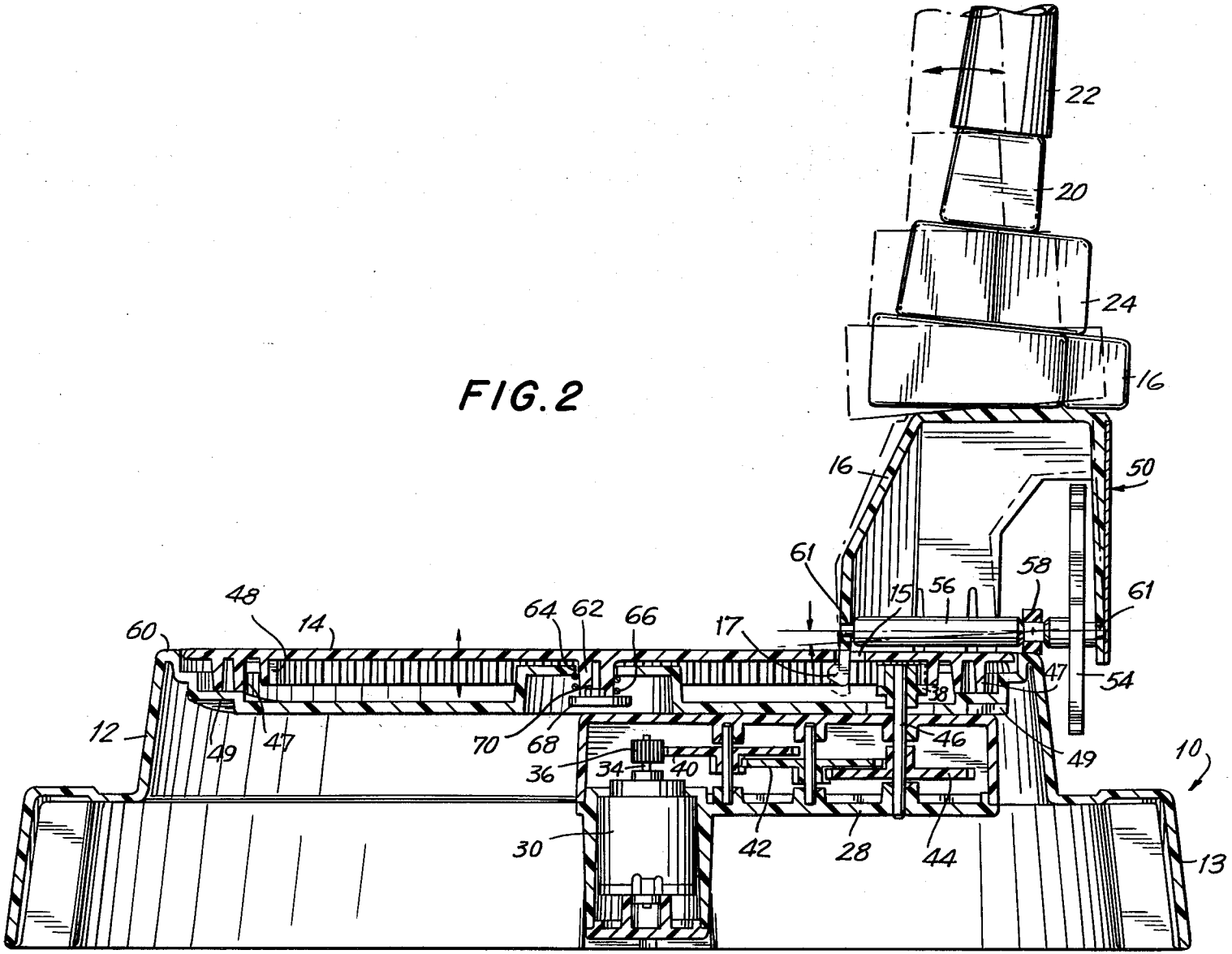
FIG. 2 is a cross-sectional view along the line 2—2 of FIG. 1.

As shown in FIG. 2, the platform 16 moves upwardly with the turntable 14, as seen by the dot-dash lines or phantom lines. In a like manner, the axis of the shaft 56 may also tilt a corresponding amount which is in the order of a few degrees, as illustrated by the acute angle between the reference arrow heads at the ends of the lines representing the axis of the shaft 56 in both the normal and the cam actuated positions. Note that although the turntable 14 is restored to its proper horizontal position by means of gravity, it is assisted by the compression spring 66 which tends to easily pull the turntable 14 down because the spring 66 is compressed when the legs or cam followers 47 ride up the ramps or cams 49 on the base 12 every 90°. Bear in mind that the maximum rise of the cam surface is in the order of about fifty thousandths of an inch so the chance of a stack of blocks being unintentionally knocked over is impossible unless the stack is so unstable that it is virtually in the process of falling over without the help of the wobble effect achieved by the cam action parts. In this connection, with this embodiment of the toy, the table can only rotate in one direction depending upon the direction of the sloping cam surfaces or ramps 49. It is also possible to have the ramps designed so that the drop-off is gradual and similar to the cam rise. In such a case, the cams or ramps would be about twice as long in length as presently illustrated in FIG. 3 of the drawing. However, the stack of blocks will still exhibit a wobble, but one which is much less than that exhibited where the drop-off from the ramps is sudden.

Although such feature is advantageous in stimulating additional interest and excitement to the game, it should be recognized that the game as broadly disclosed provides for a constantly changing configuration of the stacked elements. Thus, as each player plays the game, the next player in turn is presented with a constantly changing and varying configuration of the stack. There is a different configuration at every play of an element or playing piece, so there is a constantly changing and varying configuration of perspective. During the course of play, the same configuration cannot appear twice as each player is required to place a playing piece on the platform or stack of blocks. With a varying and changing configuration presented to a player at every turn, there is a constant challenge to a player as every turn of play requires considerable skill and concentration in determining how and where to place an element or block without causing the stack to tumble or fall down.

Figure 4:
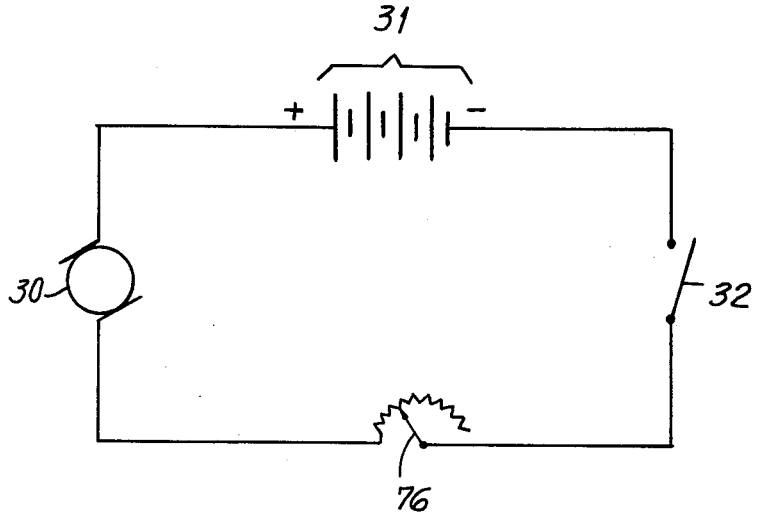
FIG. 4 is a schematic view of an electrical circuit for the toy game embodying a variable rheostat for adjusting the speed of rotation of the turntable.

As shown in FIG. 4 representing an electrical schematic of the device, a rheostat 76 may be employed, if desired, to further enhance the game by providing a greater challenge to more skillful players since the r.p.m. of the turntable 14 can be varied by adjusting the motor speed.

It will be appreciated that the table having the platform can be round or circular in form as well as in ring or annular in form. Preferrably, the platform is mounted near or at the periphery of the table or ring as the larger the diameter of the table or ring, the greater is the path of travel for the platform and thus the time allowed for a player to place a playing piece or block. In addition, although the preferred embodiment of the invention is of the type employing a disc-like table rotating in a circular manner, the platform can be mounted on a "table" operated to move in any desired track. An endless belt may be utilized, but in such a construction, the players would go in turn in consecutive and prescribed playing zones until a first player utilizes all pieces or the stack falls down. Such a table may be mounted on an elongated base. Also, for example, just as the ring or track can be linear, it can even be irregular in shape with the moving table in a form similar to an airport luggage conveying system. Thus, it is possible to provide more complex track layouts, such as rectangles, squares, triangles, figure eights etc. However, each player's area must be marked or otherwise designated to distinguish it from the adjacent players' areas. If desired, where irregular areas are formed by the track layout, the players have their choice of areas starting with a first choice with the player rolling the highest member in the die and ending with the last player drawing the lowest number. Thus, the one who goes last in the game has the advantage of choosing the most desirable quadrant or play area, such as a straight-a-way portion rather than a curved portion of the track pattern.

The base and movable table can also be vertically disposed with the platform jutting outwardly from the table for supporting thereon the playing blocks. Of course, with such an arrangement, the platform must be suitably supported so as to maintain a constant level position so the blocks can be stacked or piled thereon. This embodiment also would require playing areas, but may be most suited to be played in a solitaire fashion by just a single player because the limited space does not permit enough room for a plurality of players to maneuver in placing playing pieces on the moving table or platform.

In operation, the playing pieces or blocks would be distributed to each of the players (generally one to four, but obviously there can be more if additional playing zones are provided). The turntable is set into rotary motion by closing the switch means. The players using a die, a revolving pin wheel numbered device or any other system then determine the order of play, say for example, but letting the player with the lowest die number thrown or lowest number obtained on the pin wheel go first and the second lowest number player go next, etc.

As the platform or designated playing area comes into the first player's quadrant, he must play any piece or block of his or her choice anywhere in the designated space or atop another previously placed piece within the time it takes for the platform or designated playing area to rotate into the next player's quadrant. Each subsequent player then in turn places a piece or block on either the designated playing area if there is any room left or on any one of the previously placed or stacked playing blocks.

If upon placing a piece or playing block, the pile or any other playing block is caused to fall, the player must take all of the fallen pieces, and the game continues on until any player succeeds in placing all of his or her playing pieces. Such player is then designated as the winner of the game.

Optionally, to add more interest to the game, a player may have the option of not placing a piece or playing block on the pile or stack of blocks if he or she believes the stack will fall or collapse due to the previous player's placement of a block, and if the stack falls, the pieces go to the previous player even if the stack falls in such player's quadrant. However, a player is obligated to place a playing block if the stack does not fall or collapse and if the player does not do so, he is automatically ruled out of the game.

Figure 3:
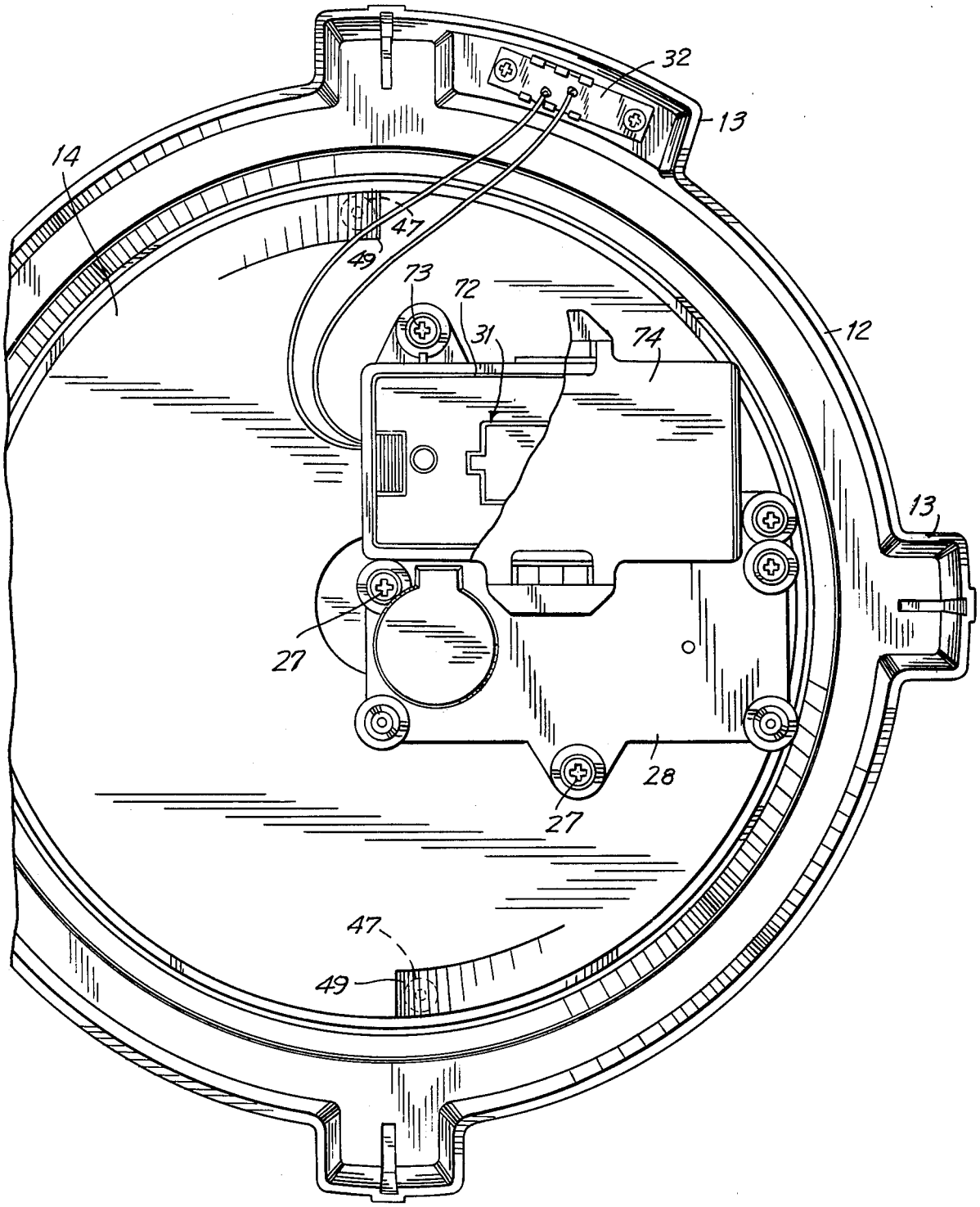
FIG. 3 is a bottom view of the base of the toy game showing the motor-gear housing and the battery housing as well as the switch means.

In the preferred embodiment of the base, it is provided with a plurality of radial projections 13 or feet-like protrusions, as shown in FIG. 3 of the drawing. Four projections are preferred as they divide the base of the game into four quadrants or zones, beginning and ending from an edge or one side of the projections. As shown in FIG. 3, these projections or their centers or an edge thereof, can be used as cues to signal a player's turn as they can be aligned with the end or drop-off of the ramps or cams. Other type of zones or segments may, if desired, be marked directly on the base so as to clearly establish the various playing zones about the circular path or other track in which the table and/or platform moves.

It should also be understood that the base and table can take the form of a suitable substrate and a monorail or other suitable track-like structure, such as a toy train track, and that the table can take the form of a flatcar, driven by conventional means, with the entire flatcar or portion thereof serving as the designated area for placing the playing pieces or blocks, and with suitable playing zones marked off around the track or other fence-like structure which may guide the car or table about a closed loop track system or the more limited "back-and-forth" straight line track system.

Also, the platform may include an appropriate illustration, such as an arrowhead or other type pointer, suitably activated by the drive train, or otherwise tripped, to return to a zero position after each playing zone is passed during every revolution of the turntable. Such a device in lieu of the caricature would signal each player's turn without the need for any other type of cueing device.

With the exception of the motor and its pinion gear, switch, wiring and terminals and the fasteners, the entire game can be fabricated from any suitable plastic material such as a high-impact polystyrene. If desired, the gears and associated shafts can be of metal or any other suitable material.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A game comprising a base adapted to be placed on a substrate, such as a floor, a movable table mounted on said base, drive means for moving said table in one plane, and means for gradually raising and then lowering said table relative to said plane, means defining a designated playing area attached to said movable table and a plurality of playing blocks, wherein said playing blocks are sequentially placed on said designated area or on another playing block by one or more players while said movable table is continuously moved in said plane and intermittently raised and lowered.

2. The game according to claim 1 including means to move said movable table in a predetermined direction.

3. The game according to claim 2, including means to move said movable table in a linear direction.

4. The game according to claim 1, including means to rotate said movable table about its axis.

5. The game according to claim 4, including a platform disposed on said movable table forming said designated playing area.

6. The game according to claim 5, wherein said platform is mounted near the peripheral portion of said movable table.

7. The game according to claim 5, wherein said platform is provided with a plurality of projections received and fixedly held in cooperatively associated apertures provided in said movable turntable.

8. The game according to claim 1, wherein said plurality of playing blocks comprising sets of differently-shaped playing blocks.

9. The game according to claim 1, wherein said base is generally round in shape and is provided with radial projections establishing quadrant playing zones and said movable table is circular in shape.

10. The game according to claim 9, wherein said drive means comprises a gear train coupled to said movable table and mounted to said base for rotating said movable table.

11. The game according to claim 10, wherein said movable table includes a gear driven by a driver gear at the output end of said gear train.

12. The game according to claim 11, wherein said gear is disposed on the underside of said movable table and is integrally formed therewith.

13. The game according to claim 10, wherein said gear train is electrically operated by means of a battery-driven motor geared to said gear train.

14. The game according to claim 13, including switch means for opening and closing an electrical circuit between said battery and said motor.

15. The game according to claim 14, wherein said switch means is mounted on one of said radial projections.

16. The game according to claim 1, wherein said means for gradually raising and lowering said table includes a plurality of cam-like ramps on the top surface of said base and said cam-like ramps having a slope gradually rising then falling in the direction of table movement in said plane, and at least one ramp engaging formation on said table positioned to engage said ramps, whereby said at least one formation periodically engages said ramps so as to slightly raise and then lower said movable table as said formation engages with and rides up and off said cam-like ramps.

17. The game according to claim 16, wherein said said at least one formation includes cam-like followers extending from the underside of said movable table and contacting said cam-like ramps of said base when said movable table is moved.

18. The game according to claim 16, wherein said movable table is circular in shape and four cam-like ramps are arcurate in shape and are provided approximately at 90° intervals about the peripheral area of said base.

19. The game according to claim 18, wherein said movable table is a turntable rotatable in only one direction about a circular path; and wherein each said cam-like ramp has has a sharp drop-off edge.

20. The game according to claim 19, wherein said path is divided into a plurality of segments.

21. The game according to claim 20, wherein said segments are in the form of quadrants for players engaged in playing the game and each quadrant extends from the drop-off edge of one cam-like ramp to the drop-off edge of the next cam-like ramp in the direction of table rotation.

22. The game according to claim 1, wherein said base and said movable table are made of a plastic material.

* * * * *